United States Patent [19]

Stotz

[11] Patent Number: 4,989,431

[45] Date of Patent: Feb. 5, 1991

[54] ROLLING DEVICE

[75] Inventor: Wolf-Gunter Stotz, Ravensburg, Fed. Rep. of Germany

[73] Assignee: Sulzer-Escher Wyss GmbH, Ravensburg, Fed. Rep. of Germany

[21] Appl. No.: 374,238

[22] Filed: Jun. 29, 1989

[30] Foreign Application Priority Data

Jun. 30, 1988 [CH] Switzerland ..... 02495/88

[51] Int. Cl.[5] ..... B21B 37/08; B21B 31/16

[52] U.S. Cl. ..... 72/21; 72/241.6

[58] Field of Search ..... 72/245, 243, 240, 241, 72/21; 29/116.2; 100/162 B, 170

[56] References Cited

U.S. PATENT DOCUMENTS

| | | | |
|---|---|---|---|
| 4,218,905 | 8/1980 | Lehmann | 72/241 |
| 4,319,522 | 3/1982 | Marchioro | 29/116.2 |
| 4,389,932 | 6/1983 | Pav | 100/162 |
| 4,472,958 | 9/1984 | Biondetti | 72/243 |
| 4,480,459 | 11/1984 | Feldman | 72/245 |
| 4,597,275 | 7/1986 | Schneid et al. | 72/21 |

*Primary Examiner*—Daniel C. Crane

[57] ABSTRACT

A roll device has upper and lower controlled deflection rolls, having sleeves which are rotatable about respective non-rotatably mounted carriers are supported on the carriers by means of force generators in the pressure plane of the roll device, and are displaceable relative to the carriers along the pressure plane over their entire length. The carrier of the upper controlled deflection roll is arranged at a fixed position relative to the stand of the roll device. The carrier of the lower controlled deflection roll is adjustable in a variable manner into a working position relative to the stand of the roll device. Regulators are provided for the controlled deflection rolls, which serve for adjusting and holding the sleeves of the controlled deflection rolls at predetermined heights and for adjusting the carrier of the lower controlled deflection roll by means of a setting device into a working position.

6 Claims, 1 Drawing Sheet

ROLLING DEVICE

Figure 1:
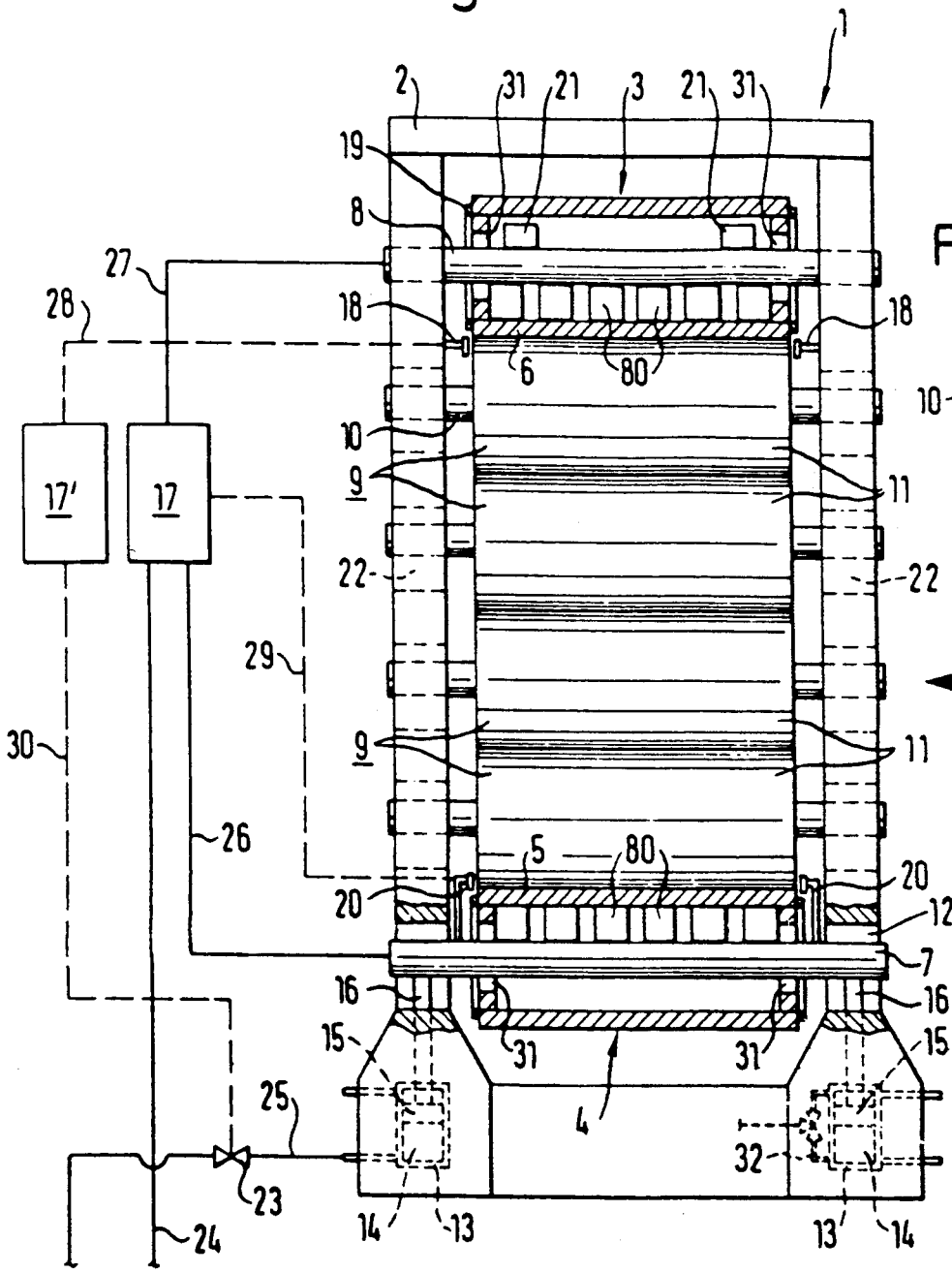

This invention relates to rolling arrangements, e.g. calenders

A rolling arrangement is for example known from U.S. Pat. No. 4,597,275. Two controlled deflection rolls are arranged in a fixed position in the stand of the rolling device which limits the possibilities for adjusting the rolls for varying roll diameters. Sufficiently wide opening of the roll device is also limited.

In a calender known from U.S. Pat. No. 4,389,932, the roll sleevings of one controlled deflection roll lie in operation against fixed stops. The advantages of free movement of the roll sleeves relative to the carrier over their entire length in the pressure plane are thus lost.

An object of the present invention is to propose a rolling arrangement which can be provided with rolls having various diameters or, as the case may be, variable diameters, the entry position of the material web between the uppermost and next uppermost rolls remaining in substantially the same position. Another object of the invention is to provide for simpler and sufficiently wide opening of the roll gap in the event of web breakage, idle running or during insertion.

Another object of the invention is to achieve substantial cost reduction by avoiding the need for devices for resetting the uppermost roll position.

Another object of the invention is to ensure adequate guidance and tensioning in the longitudinal and transverse directions during insertion of a material web into a rolling device to ensure trouble-free and fold-free passage through the nip.

According to one aspect of the invention, there is provided a roll arrangement comprising: a stand; a roll train mounted in said stand and including upper and lower controlled deflection rolls, each of which comprises a respective non-rotatable carrier and a respective sleeve displaceably supported on the associated carrier by respective force generator means in the pressure plane of the arrangement the carrier of the upper controlled deflection roll being at a fixed height relative to the stand; first regulator means for at least one of the controlled deflection rolls for setting and holding the sleeve thereof at a predetermined height relative to the associated carrier or the stand by control of its force generator means; and second regulator means for controlling the carrier position of the lower controlled deflection roll in dependence upon the sleeve height relative to the associated carrier in the respective other controlled deflection roll.

According to another aspect of the invention, there is provided a roll device comprising upper and lower controlled deflection rolls in a stand, the sleeves of which rolls are rotatable about respective non-rotatably mounted carriers, are supported on the carriers by means of force generators in the pressure plane of the rolling device, and are displaceable relative to the carriers along the pressure plane and in the pressure direction over their entire length, a regulator being provided for at least one of the controlled deflection rolls for setting and holding the sleeve of this controlled deflection roll at a predetermined height relative to the associated carrier or the stand during operation of the roll device by control of the force of its force generators in dependence upon a measurement of the controlled height of its sleeve relative to the associated carrier or stand wherein the carrier of the upper controlled deflection roll is arranged at a fixed position in the roll device and the carrier of the lower controlled deflection roll is settable by means of a setting device into a working position in the roll device to be maintained during operation, and wherein a regulator is provided for regulating the position of the one carrier in dependence upon the relative height of the sleeve from the associated carrier of the respective other controlled deflection roll which is not regulated in height.

Figure 2:
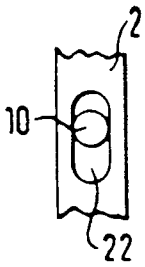

In the following, the subject matter of the invention and the advantages which can be achieved thereby are described and explained in more detail. The description refers to a drawing in which:

FIG. 1 shows a rolling device according to the invention in a schematic front view, partially in section, and FIG. 2 shows a detail from FIG. 1 viewed in the direction of the arrow A of FIG. 1.

In the illustrated calender 1, in a stand 2 are arranged an upper controlled deflection roll 3 and a lower controlled deflection roll 4. The upper and lower controlled deflection rolls each have a respective non-rotatably mounted carrier 7 or 8 around which a respective sleeve 5 or 6 is rotatable. Between the carrier 7 or 8 and the respective sleeve 5 or 6 are provided force generators 80, e.g. in the form of known hydrostatic force generators. They are arranged along the carrier in the pressure plane of the calender 1 and support the sleeve on the carrier. The sleeve 5 or 6 is displaceable relative to the respective carrier 7 or 8 along the pressure plane in the pressure direction over its entire length, guided by means of guides 31. By means of the force generators 80, the distance between the sleeve and its carrier, i.e. the vertical position of the sleeve in the gap or as the case may be relative to the carrier, can be adjusted.

In the calender 1, the carrier 8 of the upper controlled deflection roll 3 is arranged in the stand 2 at a fixed position. In contrast, the carrier 7 of the lower controlled deflection roll 4 is variably adjustable into a working support position in the calender 1. For this purpose, an adjusting device 13 is provided, by which the carrier of the lower controlled deflection roll 4 is adjustable in the stand 2 or in the calender 1 in the vertical direction along the pressure plane into a position, a height position, to be held in operation.

Regulators 17 and 17' are provided for the controlled deflection rolls 3 and 4 for setting and holding the respective sleeves at predetermined distances from the associated carriers or, as the case may be, from the stand 2 and for setting and holding the lower carrier 7 in a working position. In the illustrated example, on the one hand for the lower controlled deflection roll 4 this involves maintaining the relative distance between its sleeve 5 and its carrier 7 with the regulator 17 provided for this purpose aided by measuring devices 20. On the other hand, the regulator 17' serves for adjusting the sleeve 6 of the upper controlled deflection roll 3 into a working position; i.e. by means of measuring devices 18, the height position of the sleeve 6 is set relative to the carrier 8 or, as the case may be, relative to the support 2. This takes place whilst maintaining the required distance between the sleeve 5 and the carrier 7 of the lower controlled deflection roll 4 by positioning the carrier 7 by means of setting device 13. The term working position here means that the sleeve 6 has sufficient clearance relative to the carrier 8, that is to say upwardly and downwardly, in order that the forces from the force generators 80 can act on the sleeve over its entire circumference.

For adjusting the carrier 7 of the lower controlled deflection roll 4, as an example of a setting device a hydraulic setting motor 13 is here provided. In a cylindrical chamber 14, this has a piston 15 which is displaceable in the vertical direction. A piston rod 16 of the piston 15 acts on the carrier 7. In the stand 2, are provided two setting motors 13 on respective sides of the carrier 7. The set position of the carrier 7 in the stand 2 is ensured for example by locking the volume of pressure medium filled in the cylinder chamber 14 or by maintaining the necessary pressure of the medium present in the cylinder chamber 14. A valve 23 serves for this purpose, which is provided in a feed conduit 25 for feeding the pressure medium into the cylindrical chamber 14.

For rapid opening of the calender, a conduit 32 is provided with a valve which enables rapid discharge of the medium under the piston 15, possibly feeding a portion of the amount into the cylindrical chamber at the rear side of the piston.

As indicated in the drawing as an example, the controlled deflection rolls 3 and 4 have hydrostatic force generators 80 which are arranged along the pressure plane of the calender and are directed and operate in the pressure direction of the calender 1. In the upper controlled deflection roll is provided at least one force generator 21 which serves for lifting the sleeve of the upper controlled deflection roll, if in this connection the pressure is reduced in the downwardly pointing pressure sources 80.

The subject matter of this application is not limited to the use of hydrostatic force generators in the controlled deflection rolls 3 and 4; force generators of other types can also be used.

As explained here, the calender 1 has a plurality of intermediate rolls 9 which are arranged between the controlled deflection rolls 3 and 4. The usual solid or hollow rolls are provided with journals 10 and roll bodies 11. These rolls 9 are mounted in the stand 2 for displacement in the vertical direction, i.e. in the pressure direction, of the pressure plane. As is indicated in FIG. 2, the intermediate rolls 9 are each mounted in a respective guide 22 in the stand 2. A similar guide 12 is also provided for adjusting the displacement of the carrier 7 of the lower controlled deflection roll 4 into the required holding position in the stand 2.

The regulator 17' operates in dependence upon a measurement device 18 which senses the position, or the height setting of the sleeve 6 of the upper controlled deflection roll 3. This measuring device has a sensor, secured on the carrier 8 or the stand 2, which comes into contact with a ring 19, which ring is connected to and concentric with the sleeve 6 and rotates therewith during operation. A similar arrangement of the said measuring elements 18 and 19 is provided on both sides of the sleeve 6 of the upper controlled pressured roll 3. A similar measuring device in the form of a positioning indicator 20 is also provided on the sleeve 5 of the lower controlled deflection roll 4, although the distance of the sleeve is measured relative to the carrier 7. According to these measuring devices, the pressures in the force generators 80 of the lower controlled deflection roll 4 are set by means of the regulator 17 in such manner that a desired distance between the sleeve 5 and its carrier 7 of the controlled deflection roll 4 is always maintained during operation of the calender 1.

The position of the upper sleeve 6 can also be measured by measuring the position of one of the intermediate rolls 9 relative to the carrier 8 or to the support 2, e.g. on the journals 10 or their bearing housings.

If required, the position of the carrier 7 of the lower controlled deflection roll 4 can be altered and newly set by means of the regulator 17'. This for example may be required if the diameter of the individual component rolls should be adjusted possibly also in the event that the overall height setting of the roll system is to be changed.

As usual, the individual force generators 80 can be arranged along the respective carrier in zones in which various pressures can be adjusted according to need by means of the regulator 17.

In operation of the calender, all forces which are applied during operation are applied by the controlled deflection rolls 3 and 4 and maintained in equilibrium, i.e. the force which is exerted from above by the upper pressure setting roll 3, including the forces which are caused by the self-weight of the intermediate rolls 9, as well as the effect of friction of these rolls in the stand 2, inclusive of all other forces and imponderables, are applied by the lower controlled deflection roll 4 or via its force generators 80 so that these two force complexes, i.e. that from above acting vertically downwards and that from beneath acting vertically upwards, are completely equalised. This equilibrium is achieved if for both controlled deflection rolls 3 and 4 in each case the distance between its sleeve and its carrier, i.e. its height setting, is maintained constant or as the case may be the predetermined desired value is maintained without the sleeves coming into frictional contact with the respective carriers via their perpendicular guides 31. The regulator 17 is so arranged as to perform a corresponding pressure correction as needed in the correcting force generator 80, so that thereby the desired equilibrium is maintained.

This regulation is based on the recognition that if the predetermined position of the roll sleeves is maintained, then also the equilibrium of the force complexes in the pressure direction is achieved.

This would also function and be applicable if the pressure plane of the rolling device or the calender should not be vertical in space.

In the illustrated example, the regulator 17 is responsible for positioning the sleeve 5 and the regulator 17' is responsible for positioning the sleeve 6. The idea according to the invention of setting the height of the carrier 7 also applies however if the regulator 17 takes over the positioning of the sleeve 6 with the aid of the measuring devices 18 and the regulator 17' takes over positioning of the sleeve 5 by means of measuring devices 20.

The regulator 17 is connected to a conduit 24 for a pressure medium.

The conduit length 27 serves in the illustrated example for supplying pressure to the force generators 80 in the upper controlled deflection roll 3. From the measuring devices or sensors 20, 20 on the sleeve 5 of the lower controlled deflection roll 4, a signal is transmitted via a line 29 to the regulator 17, whereafter a conduit length 26 guides the pressure medium to the force generators 80 arranged in zones in the lower pressure setting roll 4.

A conduit 25 leads from possibly a second pressure medium source to the cylinder chamber 14 of the setting motor 13. The flow is controlled by means of a valve 23 with which also the medium volume filled in the cylinder chamber 14 can be locked or the pressure can be maintained there. Its function is regulated by the regulator 17′ via a connection conduit 30. Signals from the measuring devices or sensors 18, 18 are transmitted to the sleeve 6 of the controlled deflection roll 3 via a conduit 28 of the regulator 17′. Accordingly, the pressure medium of the setting device 13 is controlled with the corresponding pressure, that is to say via the conduit 30 to valves 23 in the conduit 25.

The subject matter of the invention is not limited to the use of a hydraulic setting motor 13. Also other setting devices would be applicable.

I claim:

1. Roll arrangement comprising: a stand; a roll train mounted in said stand and including upper and lower controlled deflection rolls, each of which comprises a respective non-rotatable carrier and a respective sleeve displaceably supported on and relative to the associated carrier by respective force generator means in the pressure plane of the arrangement, the carrier of the upper controlled deflection roll being at a fixed height relative to the stand; first regulator means for at least one of the controlled deflection rolls for setting and holding the sleeve thereof at a predetermined height relative to the associated carrier or the stand by control of its force generator means; second regulator means for controlling the carrier position of the lower controlled deflection roll in dependence upon the sleeve height relative to the associated carrier in the respective other controlled deflection roll; and at least one intermediate roll disposed between the upper and lower controlled deflection rolls with journals lying substantially in the pressure plane of the arrangement and being mounted for displacement in the pressure direction.

2. Roll arrangement according to claim 1 wherein hydraulic setting motor means is provided for positioning the carrier of the lower controlled deflection roll.

3. Roll arrangement according to claim 2 wherein said setting motor means comprises a piston and cylinder arrangement having means for fixing a desired position of the piston in the cylinder by locking of the medium in the cylindrical chamber or by maintaining a necessary pressure therein.

4. Roll arrangement according to claim 3 wherein the piston is a differential piston and feed and discharge conduits are connected such that upon lowering of the piston a portion of fluid thereby discharged is fed to the rear side of the piston whereby only the amount which corresponds to the piston rod has to be conducted from the system.

5. Roll arrangement according to claim 1 wherein said force generator means comprises hydrostatic force generators arranged on the associated carrier along the pressure plane for operation in the pressure plane of the arrangement.

6. Roll arrangement according to claim 1 wherein regulator means is also provided for changing the desired value of the height of the sleeve of the level regulated controlled deflection roll, whereby the overall height position of the roller sleeves and the rolls of the arrangement can be changed in space.

* * * * *